United States Patent [19]

Troncoso, Jr.

[11] 4,236,497

[45] Dec. 2, 1980

[54] ARCHERY BOW WITH ARROW REST

[76] Inventor: Fernando V. Troncoso, Jr., 1851 S. Orange Ave., Monterey Park, Calif. 91754

[21] Appl. No.: 2,692

[22] Filed: Jan. 11, 1979

[51] Int. Cl.[3] ..... F41B 5/00

[52] U.S. Cl. ..... 124/24 R; 124/41 A

[58] Field of Search ..... 124/24 A, 41 A, 88

[56] References Cited

U.S. PATENT DOCUMENTS

| | | | |
|---|---|---|---|
| 3,232,286 | 2/1966 | Guyton | 124/24 R |
| 3,769,956 | 11/1973 | Sino | 124/24 R X |
| 3,935,854 | 2/1976 | Troncoso | 124/24 R |

OTHER PUBLICATIONS

"New Springy Rest"—Archery Magazine, p. 43, Edition 1974, Mar.

*Primary Examiner*—Richard C. Pinkham
*Assistant Examiner*—William R. Browne
*Attorney, Agent, or Firm*—Donald E. Nist

[57] ABSTRACT

The improved archery assembly comprises, in combination, an archery bow having an arrow shelf and sidewall defining a window, an archery arrow and an improved arrow rest disposed in said window and supporting said arrow for shooting from said bow. The rest includes a flexible resilient pair of arms, spaced above the arrow shelf, defining a gap and releasably holding the arrow over the gap for free unimpeded flight in the space below the rest upon shooting the arrow. The flexible resilient arms can be made laterally and vertically adjustable and are secured to the bow by supports structure which may include a connector and a bracket secured to the bow through the connector. The arms may be, for example, horizontal coiled wires directed toward each other and upon the ends of which the arrow rests, or they may be in the form of an arcuate, depending semicircular band or cup grasping the upper and middle periphery of the arrow. With this assembly the arrow can be shot extremely accurately, because no part of the arrow contacts the bow or rest during flight of the arrow.

6 Claims, 6 Drawing Figures

ARCHERY BOW WITH ARROW REST

BACKGROUND OF THE INVENTION

1. Field of the Invention

The present invention generally relates to sport equipment and more particularly to an archery bow assembly which features fully unimpeded flight of the arrow from the bow, due to an improved rest.

2. Prior Art

The usual type of arrow rest is a fixed horizontal ledge attached to the bow sidewall and jutting out into the window above the handle and arrow shelf. The rest may be fabricated of feathers, of leather, plastic or the like and is adapted to support an arrow in the window from below. It presents a potential problem to the archer in that the arrow feathers or vanes, and even the shaft in some instances, may strike the rest as the arrow moves forward immediately after bowstring release. Such striking slows the arrow, wears and eventually damages the vanes and rest, causes arrow wobble and reduces shooting accuracy. As the vanes or feathers wear, they also cause the arrow to change its point of impact and reduce accuracy.

Striking of the rest may be avoided if the rest is made narrow enough and if the arrow shaft flexes or bends laterally enough upon release of the bowstring, thus following a pronounced S-curve;, as may be the case when the fingers or a finger tab or glove are used in drawing and releasing the bowstring. However, when a mechanical bowstring release is used to draw and release the bowstring, such lateral flexing is diminished very noticeably. This is even more the case when a compound archery bow is shot with a mechanical bowstring release. A compound bow causes the arrow to accelerate gradually enough so as to minimize lateral shaft bending and to substantially increase the likelihood of the feathers or vanes striking the rest.

Certain arrow rests employ a hinged wire component which is held magnetically in an arrow-supporting position but which swings forward and closes when struck by the arrow vane or feather. While such rests reduce arrow wear and deflection, those effects are still noticeably present. Inasmuch as archery shooting today is a highly scientific sport in which extreme accuracy is of critical importance, it would be highly desirable to be able to provide an improved archery assembly which could assure complete clearance of the arrow shaft and vanes upon shooting the arrow from the bow. Such assembly should be relatively inexpensive and durable and be particularly adapted for use with a mechanical bowstring release.

SUMMARY OF THE INVENTION

The foregoing objects have all been achieved by the improved archery assembly of the present invention. The assembly is substantially as set forth in the Abstract above. Thus, it includes an archery bow and arrow, and a rest of an improved type holding the arrow in place in the bow window. the rest includes a pair of flexible resilient arms or the like, such as a flexible resilient band, having a bottom gap over which the arrow is held. The gap size is adjustable as well as the horizontal and vertical positioning of the rest arms.

When the arrow is shot from the bow, contrary to the case with conventional release systems, it noses forward and down immediately into the space below the rest and above the shelf and then flies straight forward through that space completely free and unimpeded, without striking the bow or rest until it is past the bow. Accordingly, the arrow's flight is totally reproducible shot after shot for increased speed and accuracy. Use of the mechanical bowstring release with this assembly further assures a precisely reproducible shooting technique without the pronounced lateral arrow shaft flexing which occurs when fingers, tab or glove are used. A so-called plunger or depressible pressure point in the sidewall of the bow is not needed. Instead, the arrow does not impinge on any component of either the bow or rest, once the arrow drops below the rest at the beginning of the forward thrust of the arrow during the release. Moreover, the rest remains durable and unworn shot after shot. This is also the case with the arrow and its vanes.

In one embodiment a bracket which is used to hold components of the rest in place additionally protects them from damage and misalignment during storage and transportation of the bow. Further features of the present invention are set forth in the following detailed description and accompanying drawings.

DRAWINGS

DETAILED DESCRIPTION

Figure 1:
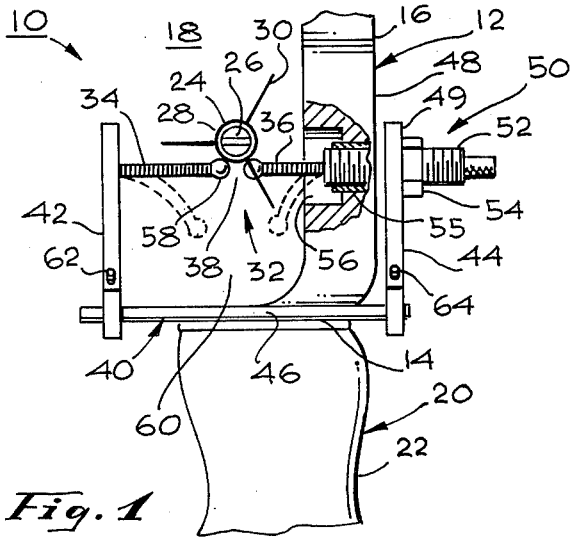
FIG. 1 is a fragmentary schematic rear elevation, partly broken away, of a first preferred embodiment of the improved archery assembly of the present invention.
Figure 2:
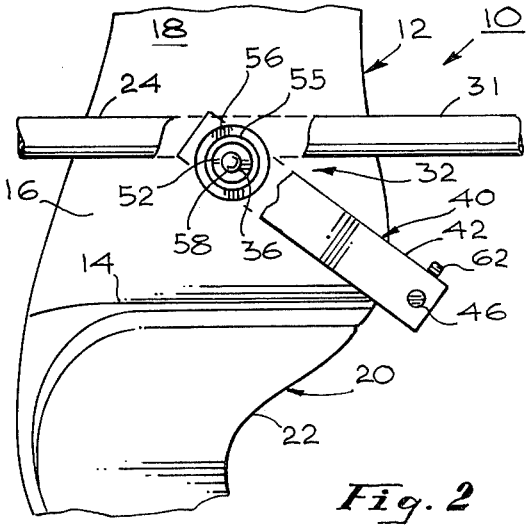
FIG. 2 is a fragmentary schematic side elevation, partly broken away, of the improved archery assembly of FIG. 1.

FIGS. 1 and 2

Now referring to FIGS. 1 and 2, a first preferred embodiment of the invention is schematically depicted therein. Thus, an archery assembly 10 is shown, which includes an archery bow 12 of any suitable type, such as a conventional recurve longbow or compound bow, having an arrow shelf 14 and sidewall 16 defining an arrow window 18 above a handle 20 in the riser section 22 of the bow. Assembly 10 also includes an archery arrow 24 having a string nock 26 at its rear end 28 and feathers or vanes 30 secured to the shaft 31 of arrow 24 adjacent rear end 28.

Arrow 24 is disposed on an arrow rest 32 in window 18 spaced from shelf 14 and sidewall 16. Rest 32 includes flexible resilient means in the form of a pair of horizontal springs 34 and 36 aligned in the same plane and spaced apart to define a gap 38 therebetween. Arrow 24 rests over gap 38. Spring 34 is held in a U-shaped bracket 40 which includes spaced first and second arms 42 and 44 sloping downwardly and rearwardly and releasably connected to a cross bar 46 behind shelf 14. Arm 42 extends into window 18 and holds spring 34 in place. Arm 44 is disposed on the side 48 of bow 12 away from window 18 and the forward end 49 thereof is releasably pivotably secured thereto by a horizontally extending fixture 50 running through sidewall 16 and end 49.

Fixture 50 includes an externally threaded shaft 52 and lock nut 54. Shaft 52 is rotatably secured in an internally threaded tube 55 set in sidewall 16. Spring 36 is secured to the end of shaft 52 in sidewall 16 and extends laterally thereof into window 18. Sidewall 16 is cut away to provide a circular pocket or recess 56 around spring 36. This is to permit spring 36 to freely flex and bend down during shooting of arrow 24 without spring 36 binding against sidewall 16 and wearing.

In order to position arrow 24 over gap 38, the ends of springs 34 and 36 which face gap 38 are provided with smoothly finished balls or bearings 58. Bearings 58 permit arrow shaft 31 to readily slip down past them when springs 34 and 36 flex down under pressure upon bowstring release during shooting of arrow 24, so that gap 38 widens (see dotted outline in FIG. 1). It is conventional to have nock 26 set in the bowstring at a level above a horizontal line from the rest to the bowstring. Even if it is not so set, the difference in limb lengths of the top and bottom limbs of an archery bow will force the point of arrow 24 to initially angle down below such horizontal line during release of the bowstring. With assembly 10 in use, this causes arrow 24 to drive initially forward and down, shaft 31 passing down through rest 32, specifically through widening gap 38, whereupon arrow 24 then levels out and flies freely and unencumbered straight forward in the space 60 above shelf 14 and below springs 34 and 36 in window 18, clearing all parts of bow 12 without touching either shaft 31 or feathers (vanes) 30 thereto. Accordingly, the flight of arrow 24 is extremely accurate and rapid.

It is most desirable that drawing and release of the bowstring be accomplished with a mechanical release to reduce or eliminate lateral oscillation of shaft 31 in space 60. In order to assure total arrow clearance during flight in space 60, regardless of the diameter of arrow 24, the lateral spacing and size of gap 38 in window 18 can be varied by horizontally moving springs 34 and 36 independently. Spring 36 can be moved by rotating shaft 52 in tube 55, carrying spring 36 with it. Spring 34 can be moved by repositioning arm 42 on bar 46. For this purpose arm 42 is provided with a set screw 62. A set screw 64 may also be provided in arm 44. Accordingly, rest 32 is fully adjustable laterally in window 18 to provide optional results. Bracket 40 protects rest 32 against damage. Moreover, bracket 40 and rest 32 are secured to sidewall 16 without requiring more than a single opening in sidewall 16.

Figure 3:
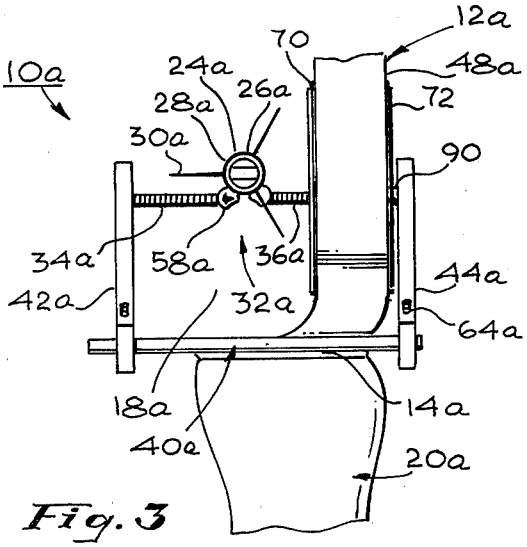
FIG. 3 is a fragmentary schematic rear elevation of a second preferred embodiment of the improved archery assembly of the present invention.
Figure 4:
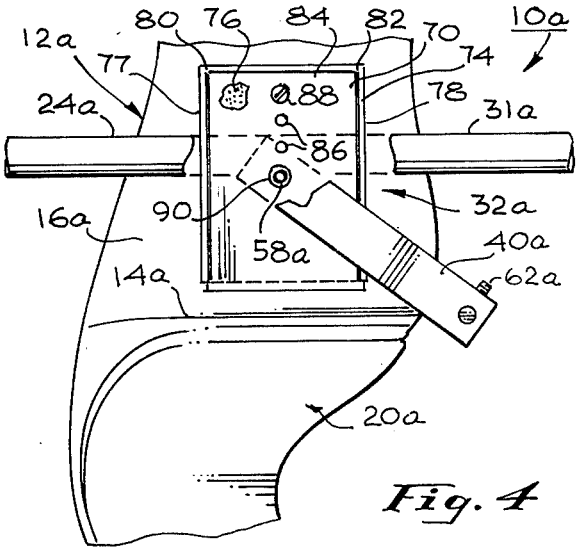
FIG. 4 is a fragmentary schematic side elevation, partly broken away, of the improved archery assembly of FIG. 3.

FIGS. 3 and 4

A second preferred embodiment of the improved archery assembly of the present invention is schematically depicted in FIGS. 3 and 4. Assembly **10*a* is depicted, and is similar to assembly 10. All components thereof similar to those of assembly 10** bear the same numerals but are succeeded by the letter "a".

Thus, assembly **10*a* includes bow 12*a* with shelf 14*a*, sidewall 16*a*, window 18*a*, and handle 20*a*, and arrow 24*a* with nock 26*a*, feathers (vanes) 30*a* and shaft 31*a*. Assembly 10*a* also includes rest 32*a* with springs 34*a* and 36*a* and bracket 40*a* with arms 42*a* and 44*a* and cross bar 46*a*. However, fixture 50 is substituted for by a pair of identical adjustable supports 70 and 72. Moreover, bearings 58*a* are not round but are cup shaped to more easily cradle arrow 24*a***.

Support 70 comprises a flat rectangular plate 74 releasably secured to sidewall **16*a* facing window 18*a*, as by a coating 76 of adhesive. The vertical leading and trailing edges 77 and 78 of plate 74 are rolled over to provide vertical pockets or tracks 80 and 82. A flat rectangular plate 84 is slideably received within tracks 80 and 82 for vertical movement relative thereto. Plates 74 and 84 have a vertical series of alignable holes 86 therethrough and a set screw 88 is provided to releasably hold plate 84 relative to plate 74**.

Plate 84 bears a fixture or tube 90 into which one end of spring 36 is releasably and adjustably received to support it in a horizontal attitude. End **49*a* of arm 44*a* is similary releasably and adjustably secured through a stud 92 to support 72 for vertical movement of bracket 40*a* and spring 34*a* to a desired position above shelf 14*a*. Thus, rest 32*a* is fully adjustable vertically as well as horizontally. Assembly 10*a* operates in the same manner as assembly 10 to permit free and unencumbered flight of arrow 24*a***.

Figure 5:
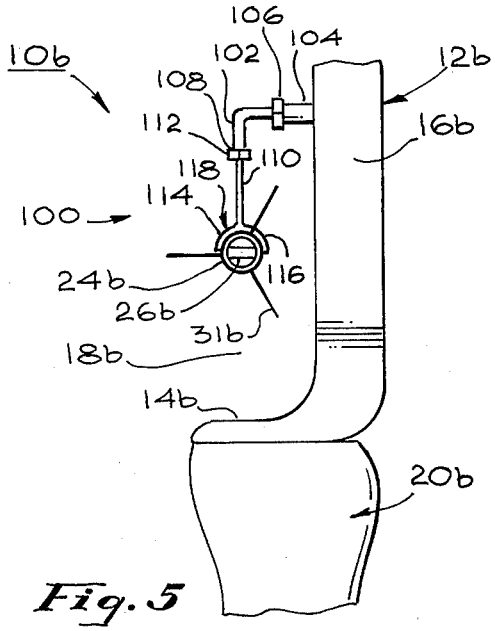
FIG. 5 is a fragmentary schematic rear elevation of a third preferred embodiment of the improved archery assembly of the present invention; and, FIG. 6 is a fragmentary schematic side elevation, partly broken away, of the improved archery assembly of FIG. 5.
Figure 6:
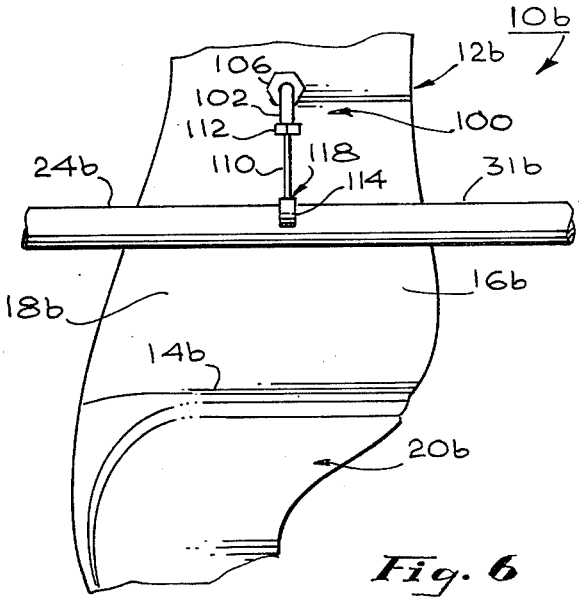

FIGS. 5 and 6

A third preferred embodiment of the improved archery assembly of the present invention is schematically depicted in FIGS. 5 and 6. Thus, assembly **10*b* is shown which is similar to assembly 10. Components thereof which are similar to those of assembly 10 bear the same numerals but are succeeded by the letter "b". Thus, assembly 10*b* includes a bow 12*b* having shelf 14*b*, sidewalls 16*b*, window 18*b* and handle 20*b*, and an arrow 24*b* with nock 26*b*, feathers (vanes) 30*b* shaft 31*b*. Assembly 10*b* further includes an arrow rest 100 which has a laterally and downwardly depending arm 102, the horizontal end of which is releasably and adjustably slideably received within a tube 104 having a lock nut 106**.

Tube 104 is secured to sidewall **16*b* above shelf 14*b*. The lower end 108 of arm 102 slideably and adjustably receives a vertical arm 110 held by a lock nut 112. Arm 110 bears a pair of curved spaced spring blades 114 and 116 which form a crescent shaped band or cup 118 open at the bottom and within which arrow 24*b* is releasably received in window 18*b* above shelf 14*b*. It will be seen that cup 118 grips only about the upper two thirds of the perimeter of shaft 31*a*. Rest 100 is fully adjustable laterally and vertically in window 18*a*. Moreover, the tension exerted by blades 114 and 116 can be adjusted by bending them. Assembly 10*b* operates in the same manner as assemblies 10 and 10*a* to permit free and unencumbered flight of arrow 24*b* for maximum effectiveness after it drops down below and clears rest 100 above shelf 14*b***.

It will be understood that assemblies 10, **10*a* and 10*b* can be made inexpensively and durably of any suitable materials, such as are conventionally used in the manufacture of bows, arrows and other archery equipment and the like. Since the rests of assemblies 10, 10*a* and 10*b*** are not struck by the arrows thereof during flight of the arrows, wear of the arrows and rests is minimal and the components of the archery assembly remain in alignment for maximum effectiveness.

Various modifications, changes, alterations and additions can be made in the improved archery assembly of the present invention and in the components and parameters thereof. All such modifications, changes, alterations and additions as are within the scope of the appended claims form part of the present invention.

What is claimed is:

1. An improved archery assembly, said assembly comprising, in combination:

a. an archery bow having an arrow shelf and sidewall defining an arrow window;

b. an archery arrow; and, c. an improved arrow rest disposed in said window and supporting said arrow for shooting from said bow, said rest including:

i. a flexible resilient pair of rest arms comprising coiled wire springs aligned generally horizontally in said window, spaced above said shelf, defining a gap therebetween and releasably holding said arrow over said gap for free unimpeded flight of said arrow in said space below said resilient arms upon shooting of said bow, and i.i. support means interconnecting said resilient pair of rest arms with said bow, said support means including a connector which secures one of said arms to said sidewall, and a bracket which secures the other of said arms to said bow, said bracket including an element lateral of said window.

2. The improved archery assembly of claim 1 wherein said bracket is disposed around said window and said sidewall and is connected to said bow through said connector, whereby said bracket protects said rest arms from damage.

3. The improved archery assembly of claim 1 wherein said resilient means are vertically adjustable to adjust the spacing thereof above said shelf.

4. The improved archery assembly of claim 1 wherein said resilient means are adjustable to vary the size and position of said gap.

5. The improved archery assembly of claim 1 wherein said arms bear arrow-cradling means.

6. The improved archery assembly of claim 1 wherein one of said arm is disposed in said connector in a recessed area of said sidewall to prevent binding of said arm with said sidewall during flexing of said arm and wherein said bracket is connected to said bow only through said connector.

* * * * *